US009405231B2

(12) United States Patent
Nedelin et al.

(10) Patent No.: US 9,405,231 B2
(45) Date of Patent: Aug. 2, 2016

(54) METHOD AND APPARATUS FOR TONER APPLICATION

(75) Inventors: Peter Nedelin, Ashdod (IL); Mark Sandler, Rehovot (IL); Shai Lior, Rehovot (IL)

(73) Assignee: Hewlett-Packard Indigo B.V., Amstelveen (NL)

( * ) Notice: Subject to any disclaimer, the term of this patent is extended or adjusted under 35 U.S.C. 154(b) by 0 days.

(21) Appl. No.: 14/411,700

(22) PCT Filed: Jul. 12, 2012

(86) PCT No.: PCT/EP2012/063746
§ 371 (c)(1),
(2), (4) Date: Mar. 27, 2015

(87) PCT Pub. No.: WO2014/008945
PCT Pub. Date: Jan. 16, 2014

(65) Prior Publication Data
US 2015/0268589 A1 Sep. 24, 2015

(51) Int. Cl.
*G03G 15/10* (2006.01)
*G03G 15/00* (2006.01)

(52) U.S. Cl.
CPC ..... *G03G 15/101* (2013.01); *G03G 15/104* (2013.01); *G03G 15/6558* (2013.01); *G03G 2215/00801* (2013.01); *G03G 2215/0174* (2013.01)

(58) Field of Classification Search
CPC ..... G03G 15/101
USPC ..... 399/237
See application file for complete search history.

(56) References Cited

U.S. PATENT DOCUMENTS 3,891,434 A * 6/1975 Taege ..... G03G 15/108 399/239
6,259,887 B1 7/2001 Awano
6,534,154 B1 3/2003 Hayashi et al.
7,546,080 B2 6/2009 Tanaka et al.
7,972,759 B2 7/2011 Fujimoto et al.

(Continued)

FOREIGN PATENT DOCUMENTS

DE 102007011603 A1 11/2008
GB 1274181 5/1972

(Continued)

OTHER PUBLICATIONS

European Patent Office, Notification of Transmittal of the International Search Report and the Written Opinion of the International Searching Authority, or the Declaration for PCT/EP2012/063746 dated Mar. 14, 2013 (11 pages).

(Continued)

*Primary Examiner* — David Gray
*Assistant Examiner* — Tyler Hardman
(74) *Attorney, Agent, or Firm* — HP Inc Patent Department

(57) ABSTRACT

Apparatus is described which, in use, applies a thin film of a wetting agent, such as water or a water-based solution, onto paper or other print medium before applying a liquid toner. The wetting agent is applied at a predetermined distance from an image transfer area. The wetting agent acts to promote adhesion of the liquid toner to the print medium. The adhesion of the liquid toner to the print medium is further improved by supplying the wetting agent at a temperature higher than room temperature.

20 Claims, 8 Drawing Sheets

(56) References Cited

U.S. PATENT DOCUMENTS

| | | | | |
|---|---|---|---|---|
| 2003/0213171 | A1* | 11/2003 | Kruer | A01G 25/020 47/62 E |
| 2005/0158099 | A1* | 7/2005 | Segerer | G03G 15/6538 399/407 |
| 2006/0133876 | A1* | 6/2006 | Kougami | G03G 15/6573 399/407 |
| 2009/0041492 | A1* | 2/2009 | Horike | G03G 15/1695 399/55 |
| 2010/0230038 | A1* | 9/2010 | Gila | G03G 9/13 156/231 |
| 2011/0003245 | A1* | 1/2011 | Pohlt | G03G 9/13 460/115 |

FOREIGN PATENT DOCUMENTS

| | | | |
|---|---|---|---|
| JP | 59-029269 | A * | 2/1984 |
| JP | 2005140812 | A | 6/2005 |
| JP | 2012032458 | A | 2/2012 |
| WO | WO-9613760 | | 5/1996 |

OTHER PUBLICATIONS

Laurence, Leroy, European Commission, TONA Report Summary, Project reference: QLK5-CT-1999-00929, Funded under: FP5-Life Quality, Country: France, Improvement of Dry Toner Digital Print Quality for Efficient Communication, Last Updated Jul. 29, 2004 (2 pages).

* cited by examiner

METHOD AND APPARATUS FOR TONER APPLICATION

CROSS-REFERENCE TO RELATED APPLICATION

This application is a national stage application under 35 U.S.C. §371 of PCT/EP2012/063746, filed 12 Jul. 2012, which is hereby incorporated by reference.

BACKGROUND

Digital offset color technology combines ink-on-paper quality with multi-color printing on a wide range of paper, foil and plastic substrates. Digital printing presses that use digital offset color technology offer cost-effective short-run printing, on-demand service and on-the-fly color switching.

A digital offset printing system works by using digitally controlled lasers to create a latent image in the charged surface of a photo imaging plate (PIP). The lasers are controlled according to digital instructions from a digital image file. Digital instructions typically include one or more of the following parameters: image color, image spacing, image intensity, order of the color layers, etc. Special ink is then applied to the partially-charged surface of the PIP, recreating the desired image. The image is then transferred from the PIP to a heated blanket cylinder and from the blanket cylinder to the desired substrate, which is placed into contact with the blanket cylinder by means of an impression cylinder. The ink is fluid on the heated blanket. Because of its role in transferring an image from the PIP to the ultimate substrate, the blanket may sometimes be referred to as an "intermediate transfer member" (ITM). To withstand handling or post-processing, the ink on a suitable substrate must adhere to the substrate sufficiently well.

A detailed description of the operation of a typical digital offset printer is described in Hewlett-Packard (HP) White Paper Publication, "Digital Offset Color vs. Xerography and Lithography", for example. Specifically, an example of a digital printer that can be used to create the disclosed printed articles is HP's digital printing press Indigo Press™ 1000, 2000, 4000, or newer, presses, manufactured by and commercially available from Hewlett-Packard Company of Palo Alto, Calif., USA.

BRIEF DESCRIPTION OF THE DRAWINGS

Various features and advantages of the present disclosure will be apparent from the detailed description which follows, taken in conjunction with the accompanying drawings, which together illustrate, by way of example only, features of the present disclosure. The illustrated examples do not limit the scope of the claims.

DETAILED DESCRIPTION

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples.

Figure 1A:
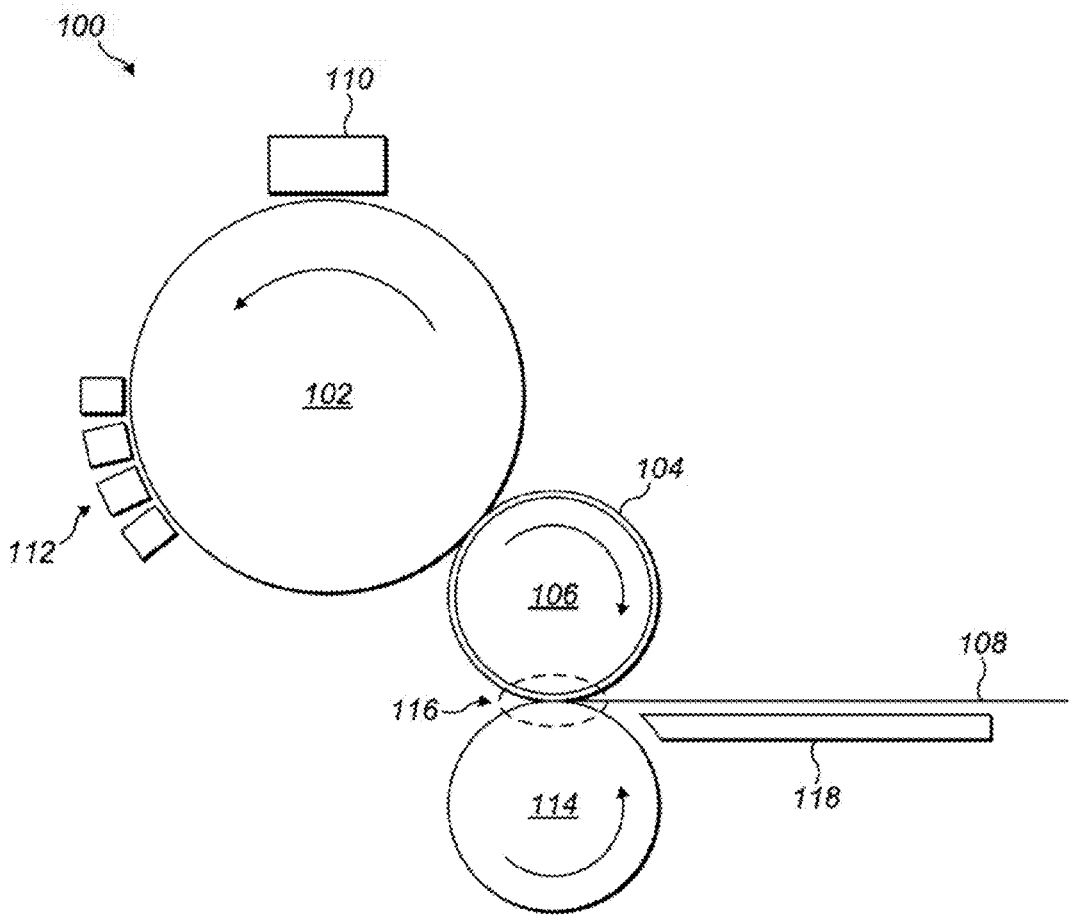
FIG. 1*a* is a diagram of an illustrative digital offset printing system.

FIG. 1*a* is a diagram of an illustrative digital offset printing system, which in this example is a digital Liquid Electro Photographic (LEP) printing system in accordance with an example. The term "Liquid Electro Photographic" or "LEP" refers to a process of printing in which a liquid toner is applied onto a surface having a pattern of electrostatic charge, to form a pattern of liquid toner corresponding with the electrostatic charge pattern. This pattern of liquid toner is then transferred to at least one intermediate surface, and then to a print medium. During the operation of a digital LEP system, ink images are formed on the surface of a photo-imaging cylinder. These ink images are transferred to a heated blanket cylinder and then to a print medium. The photo-imaging cylinder continues to rotate, passing through various stations to form the next image.

In the illustrative digital LEP system 100, the desired image is communicated to the printing system 100 in digital form. The desired image may include any combination of text, graphics and images. The desired image is initially formed on a photo-imaging cylinder 102, is then transferred to a blanket 104 on the outside of a blanket cylinder 106, and then transferred to a print medium 108. The blanket 104 may otherwise be referred to as an intermediate transfer member (ITM).

According to one illustrative example, an image is formed on the photo-imaging cylinder 102 by rotating a clean, bare segment of the photo-imaging cylinder 102 under a photo charging unit 110. The photo charging unit 110 includes a charging device such as corona wire, charge roller, or other charging device and a laser imaging portion. A uniform static charge is deposited on the photo-imaging cylinder 102 by the photo charging unit 110. As the photo-imaging cylinder 102 continues to rotate, it passes the laser imaging portion of the photo charging unit 110 that dissipates localized static charge in selected portions of the photo-imaging cylinder 102 to leave an invisible electrostatic charge pattern that represents the image to be printed. Typically, the photo charging unit 110 applies a negative charge to the surface of the photo-imaging cylinder 102. The laser imaging portion of the photo charging unit 110 then locally discharges portions of the photo imaging cylinder 102.

In the described example, ink is transferred onto the photo-imaging cylinder 102 by Binary Ink Developer (BID) units 112. There is one BID unit 112 for each ink color. During printing, the appropriate BID unit 112 is engaged with the photo-imaging cylinder 102. The engaged BID unit presents a uniform film of ink to the photo-imaging cylinder 102. The ink contains electrically charged pigment particles which are attracted to the opposing electrical fields on the image areas of the photo-imaging cylinder 102. The ink is repelled from the uncharged, non-image areas. The photo-imaging cylinder 102 now has a single color ink image on its surface. In other examples, such as those for black and white (monochromatic) printing, one or more ink developer units may alternatively be provided.

The ink may be a liquid toner ink, such as HP Electroink. In this case pigment particles are incorporated into a resin that is suspended in a carrier liquid, such as Isopar. The ink particles may be electrically charged such that they move when subjected to an electric field. Typically, the ink particles are negatively charged and are therefore repelled from the negatively charged portions of the photo imaging cylinder 102, and are attracted to the discharged portions of the photo imaging cylinder 102. The pigment is incorporated into the resin and the compounded particles are suspended in the carrier liquid. The dimensions of the pigment particles are such that the printed image does not mask the underlying texture of the print medium 108, so that the finish of the print is consistent with the finish of the print medium 108, rather than masking the print medium 108. This enables LEP printing to produce finishes closer in appearance to conventional offset lithography, in which ink is absorbed into the print medium 108.

Typically, ink is applied to the ITM 104 at a concentration of 20% (with the remaining 80% comprising carrier liquid). During the printing process, and due at least in part to the heating of the ITM 104, a large proportion of the carrier liquid is evaporated prior to transfer of the ink to the print medium 108. The evaporated carrier liquid is collected from the areas surrounding the ITM 104 by a suction device; it is then carried to a 'capture and control' unit that comprises a heat exchanger where it condenses. During this process, moisture (water vapor) from the air also condenses. The 'capture and control' unit is arranged to separate the carrier liquid from the condensed water (since the carrier liquid is significantly lighter than water), and recycle the carrier liquid in the printing process.

Returning to the printing process, the photo-imaging cylinder 102 continues to rotate and transfers the ink image to the ITM 104 of the blanket cylinder 106 which is heatable. The blanket cylinder 106 transfers the image from the ITM 104 to a sheet of print media 108 wrapped around an impression cylinder 114. As will be further described below, this process may be repeated for each of the colored ink layers to be included in the final image.

The print medium 108 may be any coated or uncoated paper material suitable for liquid electrophotographic printing. In certain examples, the paper comprises a web formed from cellulosic fibers, having a basis weight of from about 75 gsm to about 350 gsm, and a calliper (i.e. thickness) of from about 4 mils (thousandths of an inch—around 0.1 millimeters) to about 200 mils (around 5 millimeters). In certain examples, the paper includes a surface coating comprising starch, an acrylic acid polymer, and an organic material having an hydrophilic-lipophilic balance value of from about 2 to about 14 such as a polyglycerol ester.

The print medium 108 may be fed on a per sheet basis, or from a roll sometimes referred to as a web substrate. The print medium 108 enters the printing system 100 from one side of an image transfer region 116, shown on the right of FIG. 1*a*. It then passes over a feed tray 118 and is wrapped onto the impression cylinder 114. As the print medium 108 contacts the ITM 104 of the blanket cylinder 106, the single color ink image is transferred to the print medium 108. The creation, transfer, and cleaning of the photo-imaging cylinder 102 is a continuous process, with the capability to create and transfer hundreds of images per minute with a typical print rate of more than 2 $ms^{-1}$ (i.e. the rate at which the print medium 108 is fed through the LEP system 100).

The image transfer region 116, commonly referred to as "the nip", is a region between the ITM 104 of the blanket cylinder 106 and the impression cylinder 114 where the two cylinders 106, 114 are in close enough proximity to apply a pressure to the back side of the print medium 108 (i.e. the side on which the image is not being formed), which then transmits a pressure to the front side the print medium 108 (i.e. the side on which the image is being formed). The distance between the two cylinders 106, 114 can be adjusted to produce different pressures on the print medium 108 when the print medium 108 passes through the image transfer region 116, or to adjust the applied pressure when a print medium 108 of a different thickness is few through the image transfer region 116.

To form a single color image (such as a black and white image), one pass of the print medium 108 between the impression cylinder 114 and the blanket cylinder 106 completes the desired image. For a color image, the print medium 108 is retained on the impression cylinder 114 and makes multiple contacts with the blanket cylinder 106 as it passes through the image transfer region 116. At each contact, an additional color plane may be placed on the print medium 108.

For example, to generate a four color image, the photo charging unit 110 forms a second pattern on the photo-imaging cylinder 102, which receives the second ink color from a second BID unit 112. In the manner described above, this second ink pattern is transferred to the ITM 104 and impressed onto the print medium 108 as it continues to rotate with the impression cylinder 114. This continues until the desired image with all four color planes is formed on the print medium 108. Following the complete formation of the desired image on the print medium 108, the print medium 108 can exit the machine or be duplexed to create a second image on the opposite surface of the print medium 108. Because the printing system 100 is digital, the operator can change the image being printed at any time and without manual reconfiguration.

As described above, the ink on a suitable substrate must adhere to the substrate sufficiently well to withstand handling or post-processing. In printing processes that are not based on ink absorption and media capillarity, the ink adhesion significantly depends on ink transfer parameters such as the temperature of the blanket of the ITM 104, and the pressure applied by the ITM 104 and the impression cylinder 114 to the print medium 108.

In other comparative printing systems, ink adhesion may be improved by applying one of the following steps: treating the substrate with a solvent-based adhesion promoter; selecting specially-formed print media that have good adhesion properties for a given liquid toner; and coating, laminating or otherwise encapsulating the substrate to create a protective layer over the print. Each of these methods of improving the adhesion of the liquid toner to the substrate has disadvantages. For example, they come with added complexity, the requirement for dedicated addition equipment and therefore additional cost and, where solvent-based adhesion promoters are used, additional safety requirements and considerations.

In accordance with examples described herein, there is provided an apparatus and method for providing a supply of liquid toner to a selectively charged photo-imaging cylinder, wetting a print medium and subsequently transferring the liquid toner from the photo-imaging cylinder to the print medium. In some examples, transfer of the liquid toner from the photo-imaging cylinder to the print medium comprises intermediate operations. For example, in some examples, transferring the liquid toner from the photo-imaging cylinder to the print medium comprises transferring liquid toner from the photo-imaging cylinder to a print medium via an intermediate transfer member. Wetting the print medium prior to transferring liquid toner to the print medium improves adhesion of the liquid toner to the print medium. Wetting the print medium may also improve resistance of the ink to damage. In some examples, the print medium is wetted at a predetermined distance from a position where the liquid toner is transferred, such that the print medium is wetted prior to the transfer of the liquid toner to the print medium. This provides for an appropriate amount of wetting of the print medium for a given print medium type, and for a given print medium feed rate. In certain examples the print medium is wet in a pre-processing procedure, i.e. before printing begins.

Figure 1B:
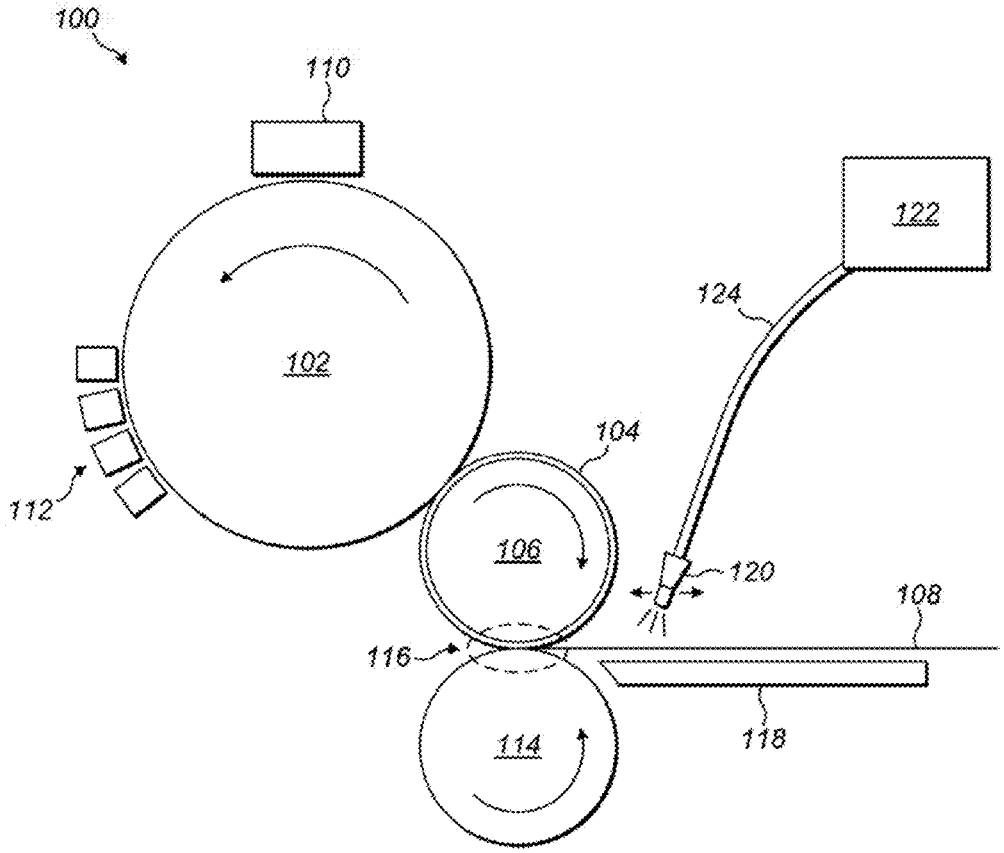
FIG. 1*b* is a diagram of an illustrative digital offset printing system in accordance with an example.

In the example shown in FIG. 1*b*, the printing system 100 comprises a water applicator 120 fed by a supply of water 122. The supply of water 122 may be a reservoir located at or near to the water applicator 120, or located elsewhere within the printing device 100, and connected to the water applicator 120 by, for example, a hose 124 as shown in FIG. 1*b*. Alternatively, the supply of water 122 may be a reservoir external to the printing device 100 or may be supplied from a water main. In some examples, water that has been applied to the print medium 108 may be recovered and recycled for subsequent printing or for other processes in the printing device 100. In some examples, the water may be sourced from the capture and control' unit as described above.

For ease of explanation, wetting of the print medium 108 is described in relation to the application of a water-based solution. The water-based solution, in certain examples, may comprise water (i.e. $H_2O$) from a domestic or industrial water source. In some examples, the wetting agent may be an aqueous solution in which other materials may be dissolved or otherwise suspended. For example, the wetting agent may include surfactants, such as alcohol, to improve the wetting ability of the wetting agent, or the wetting agent may include anti-biological materials such as mould inhibitors to prevent fouling of the wetting agent, and possible staining or other quality reducing artifacts in the resulting print.

The water applicator 120 is arranged to apply an amount of water onto a region of the print medium 108 to wet that region of the print medium 108 prior to it entering the ink transfer region 116, and hence, prior to coming into contact with the intermediate transfer member. 104 and having ink transferred therefrom. Wetting the print medium 108 changes the moisture content of the print medium 108 prior to receiving ink.

In the illustrated example, the amount of water and the area over which the water is applied are carefully controlled to provide a uniform film of water and to prevent the formation of droplets and the excessive wetting of the print medium 108. Typically, a layer of water approximately 2 micrometers thick is applied to the print medium 108 at a predetermined distance from the ink transfer region 116; however, in practice the distance from the ink transfer region 116 that the water is applied, and the thickness of the applied film of water may be varied according to the speed at which the print medium 108 is fed through the printing system 100 and the particular print medium 108 to which an image is being applied. Typically, the film of water is applied 1-2 seconds prior to ink transfer, for a print medium feed rate of 2 $ms^{-1}$.

In some examples, the water applicator 120 may be mounted on a movable mount such that the predetermined distance may be varied between or even during a printing operation. For instance, the predetermined distance may be varied between printing operations based on a type of print medium 108 or the predetermined distance may be varied during a printing operation to adjust and/or optimize the print quality (for example, during maintenance or set-up). Typically, water is applied to the print medium at an ambient temperature; however, water may be applied at any temperature within a predetermined range of temperatures.

In certain implementations, the water applicator 120 may be one or more of a spray nozzle, a wetting roller, an atomizer, a water vaporizer, or a capillary cloth. In certain other implementations, the application may be one or more of a wiper, a rod, or a doctor blade.

Figure 2A:
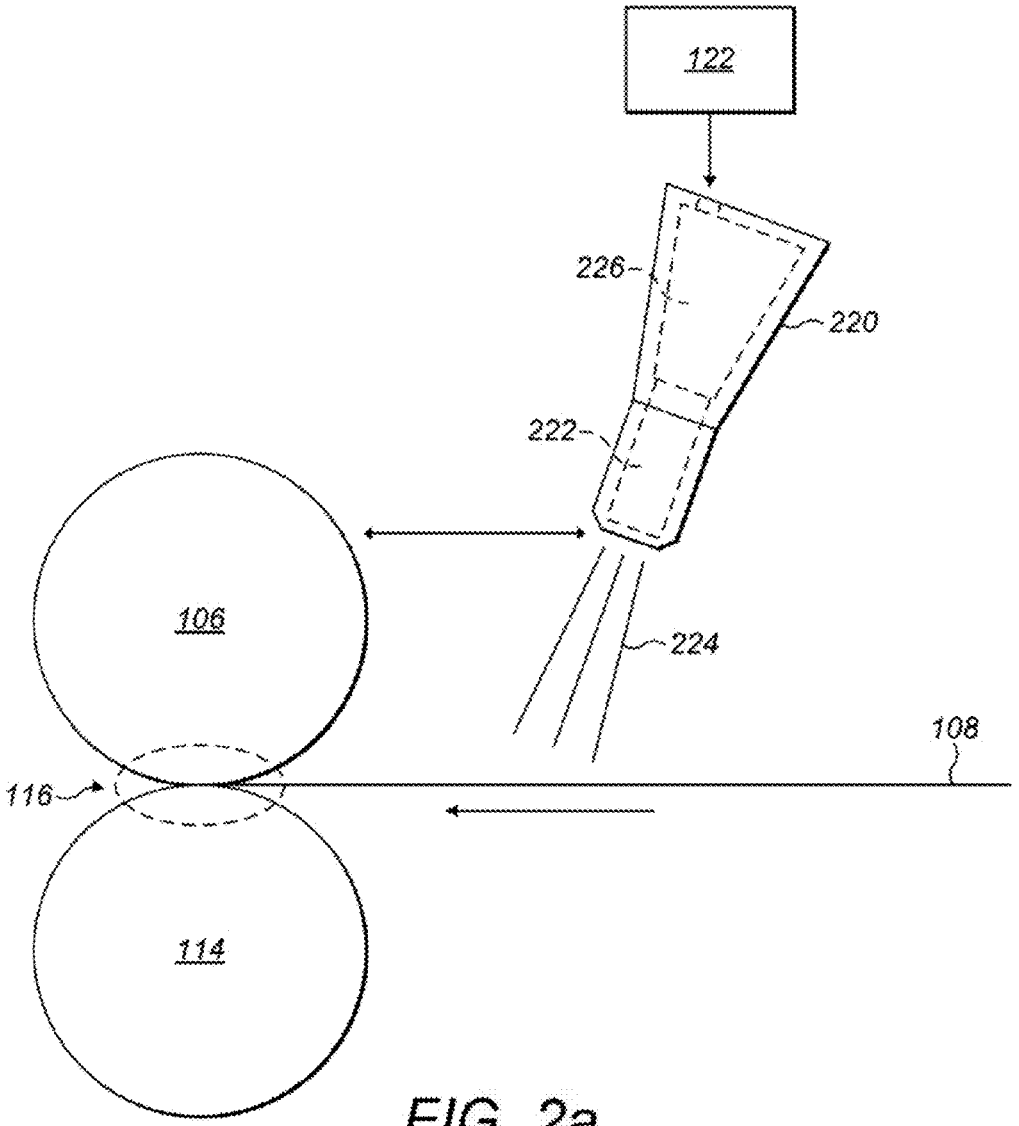
FIG. 2*a* is a diagram of a first water applicator in accordance with an example.

FIG. 2*a* shows an example in which the water applicator 120 comprises a nozzle 220. The nozzle 220 comprises an aperture 222 through which the water is directed at the print medium 108. The nozzle 220 directs water in a coherent stream 224 into the atmosphere (e.g. the air) surrounding the nozzle 220, i.e. the space between the nozzle 220 and the print medium 108. The nozzle 220 enables control over one or more of the direction and flow rate, speed, mass, shape and/or pressure of the stream of water emerging from the nozzle 220.

The nozzle 220 may comprise an internal reservoir 226 for holding a supply of water at or near the nozzle 220. The reservoir 226 may be a self-contained supply of water that is replaced or replenished periodically (i.e. when the supply of water is depleted), or the reservoir 226 may be fluidically connected via, for example, a hose to a remote water supply 122, which may be located elsewhere within, or external to, the printing device 100.

It will be apparent to one skilled in the art that many other configurations of nozzle 220 are possible. For example, the nozzle 220 could be arranged to produce a spray of water with a controlled shape, size and direction as well as flow etc. but distributing the water over an area, thereby increasing the surface area of the sprayed water and increasing the speed at which droplets hit the print medium 108.

In some examples, the nozzle 220 may comprise an atomizer nozzle in which air or another gas is injected under pressure through the nozzle 220, and in which the aperture 222 of the nozzle 220 has a decreasing internal dimension (e.g. diameter) as the water travels towards the aperture opening of the nozzle 220. In such examples, as gas travels through the nozzle 220, the speed of the gas increases as the cross-sectional area of the aperture 222 decreases, which causes the pressure of the gas to decrease. The decrease in pressure causes water to be picked up from a water reservoir (through a narrow opening) into the moving gas flow and be carried through the aperture 222 and be projected toward the print medium 108 as a fine spray or aerosol.

Figure 2B:
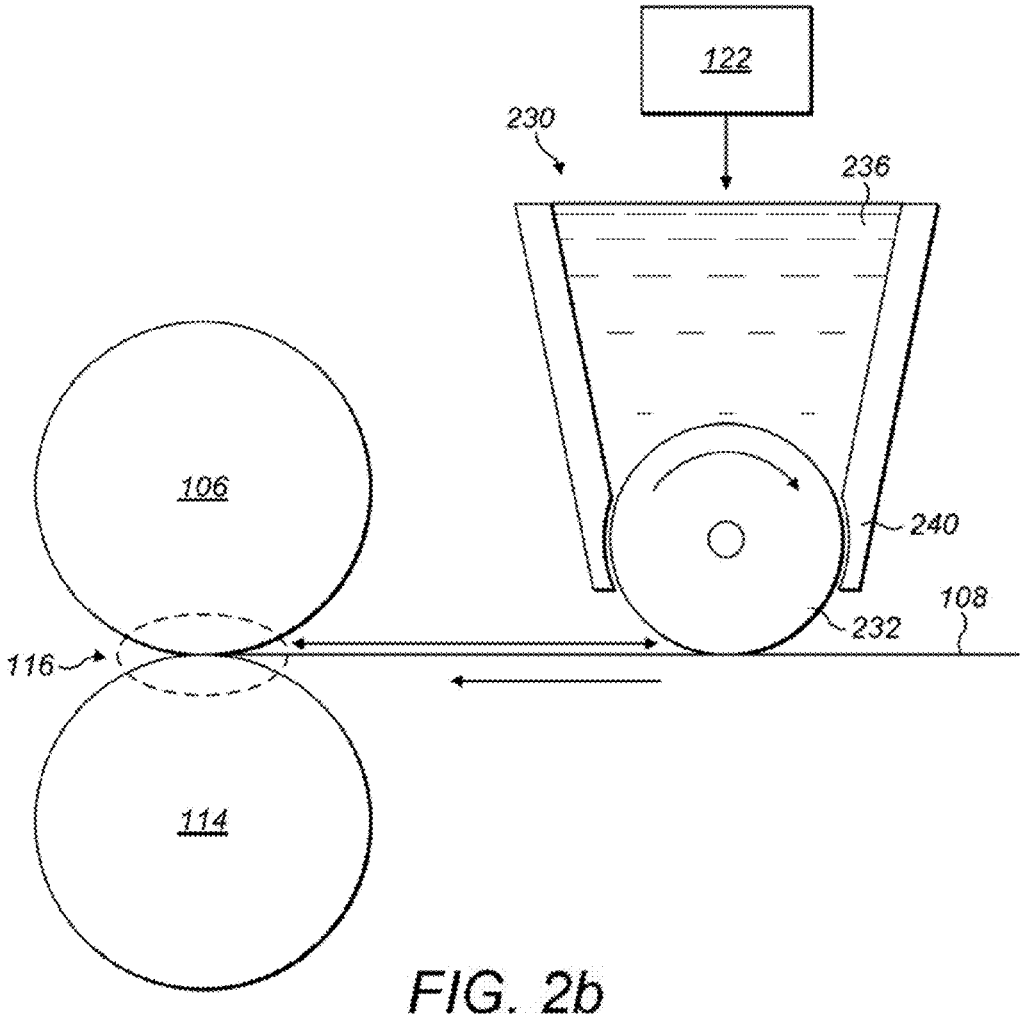
FIG. 2*b* is a diagram of a second water applicator in accordance with an example.

FIG. 2*b* shows an example where the water applicator 120 is a roller assembly 230. In this particular example the roller assembly 230 comprises a cylindrical roller 232 seated in a semi-sealed opening 234 and a reservoir 236 for containing a supply of water 238. The reservoir 236 may be fluidically connected via, for example, a hose to a remote water supply 122, which may be located elsewhere within, or external to, the printing device 100.

The roller has an axle 238 defining an axis of rotation that is perpendicular to the direction of travel of the print medium 108. The roller 232 is made of a material that absorbs or otherwise holds an amount of water. In this roller example, at any given rotational position of the roller 232, a portion of the roller 232 is exposed to the water in the reservoir 236 and a portion of the roller 232 is on contact with the print medium 108.

The roller 232 is located in a roller seat 240. The roller 232 and the roller seat 240 are of dimensions such that there is a partial seal between the roller 232 and the roller seat 240; when the roller 232 is stationary, water is not able to flow freely out from the reservoir 236 past the roller 232, but when the roller 232 rotates about its axle 238, water can be carried on the roller 232 and thereby leave the reservoir 236.

As the roller 232 rotates, a portion of the roller 232 that was in contact with the water in the reservoir 236 moves around the axis of rotation of the roller 232 and comes into contact with the print medium 108.

As the roller 232 comes into contact with the print medium 108, water is transferred from the roller 232 to the print medium 108. This may be due to one or more of a pressure applied by the roller 232, a concentration gradient (i.e. the print medium 108 is drier than the roller 232), an absorbency of the print medium 108, and capillary action.

Since the roller 232 is in contact with the print medium 108, friction between the roller 232 and the print medium 108 enables the roller 232 to be driven by, print medium 108 as print medium 108 passes through the printing device 100; the linear movement of the print medium 108 may cause rotation of the roller 232.

Examples where the roller 232 is driven by the print medium 108 have the advantage that the rate of delivery of Water varies in accordance with the feed rate of the print medium 108. Therefore, control of the delivery of water is relatively simple. In some examples, the roller 232 may be driven, for example, by a motor or drive belt.

Figure 2C:
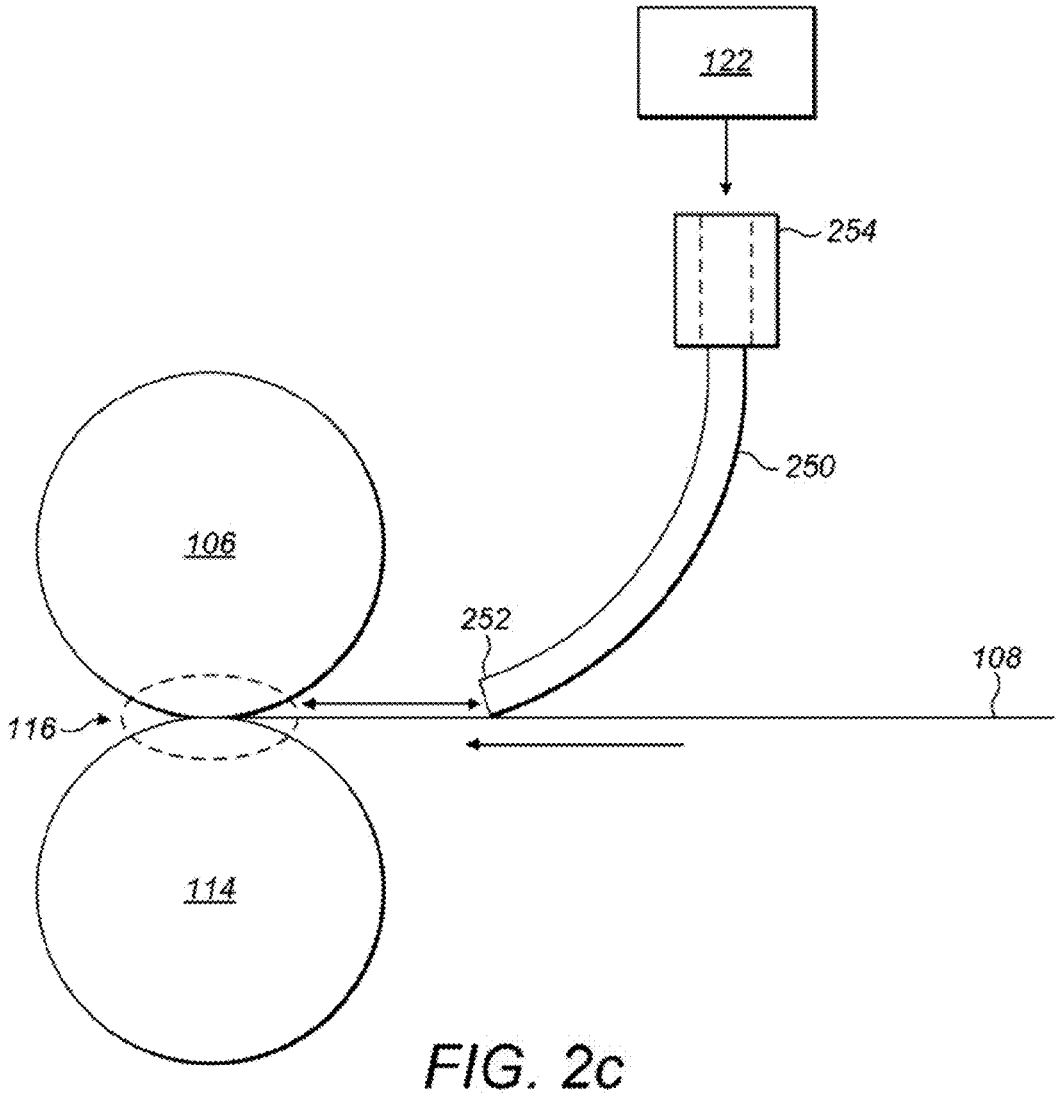
FIG. 2*c* is a diagram of a third water applicator in accordance with an example.

FIG. 2*c* shows an example in which the water applicator 120 is a capillary action fabric, hereinafter referred to as a capillary cloth 250. The capillary cloth 250 is arranged so that one end, referred to hereinafter as the wetting end 252, comes into contact with, i.e. sweeps, over the print medium 108 as the print medium 108 passes through the printing system 100. Another end, hereinafter referred to as the supply end 254, is connected to a supply of water 122. The supply of water 122 may be a reservoir for holding a self-contained supply of water that is replaced or replenished periodically (i.e. when the supply of water is depleted), or may be fluidically connected via, for example, a hose to a remote water supply 122, which may be located elsewhere within, or external to, the printing device 100. Alternatively, the supply of water 122 may be fluidically coupled directly to the supply end 254 of the capillary cloth 250.

The capillary cloth 250 draws water at the supply end 254 from the supply of water 122 (either directly or indirectly) by capillary action. The wetting end 252 of the capillary cloth 250 is in contact with the print medium 108, and by the same means as described above for the roller 232 described with reference to FIG. 2*b*, water may be transferred from the wetting end 252 of the capillary cloth 250 on to, or in to, the print medium 108. As water is drawn from the wetting end 252 of the capillary cloth 250 by the print medium 108 it is replaced by more water drawn by capillary action from the supply of water 122 at the supply end 254.

Figure 3A:
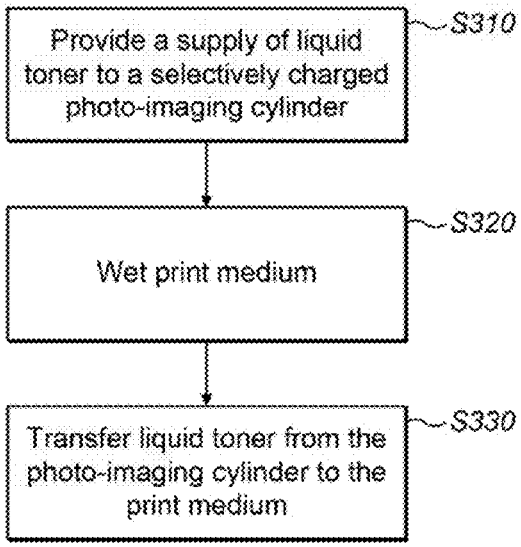
FIG. 3*a* is a flow diagram representing a method of applying water to a print medium in accordance with an example.

FIG. 3*a* shows a method of applying ink to a print medium 108 according to an example. At block S310, a supply of ink or liquid toner is provided to a selectively charged photo-imaging cylinder 102. The selective charging of the photo-imaging cylinder 102 may be performed in a previous operation using the photo charging unit 110, and the ink may be provided by one or more Binary Ink Developer (BID) units 112, described above in relation to FIG. 1*a*, or by some other means. At block S320, the print medium is wetted. This block may be performed by applying water, or an aqueous wetting agent, to the print medium 108 using an applicator 120, 220, 230, 250 as described above with reference to any of FIGS. 1*b* and 2*a* to 2*c*. The water may be at least partially absorbed by the print medium 108 to change its moisture content prior to receiving ink. At block S330, ink or liquid toner is transferred from the photo-imaging cylinder 102 to the print medium 108, in order to form an image corresponding with the pattern of selective charge on the photo-imaging cylinder 102.

Figure 3B:
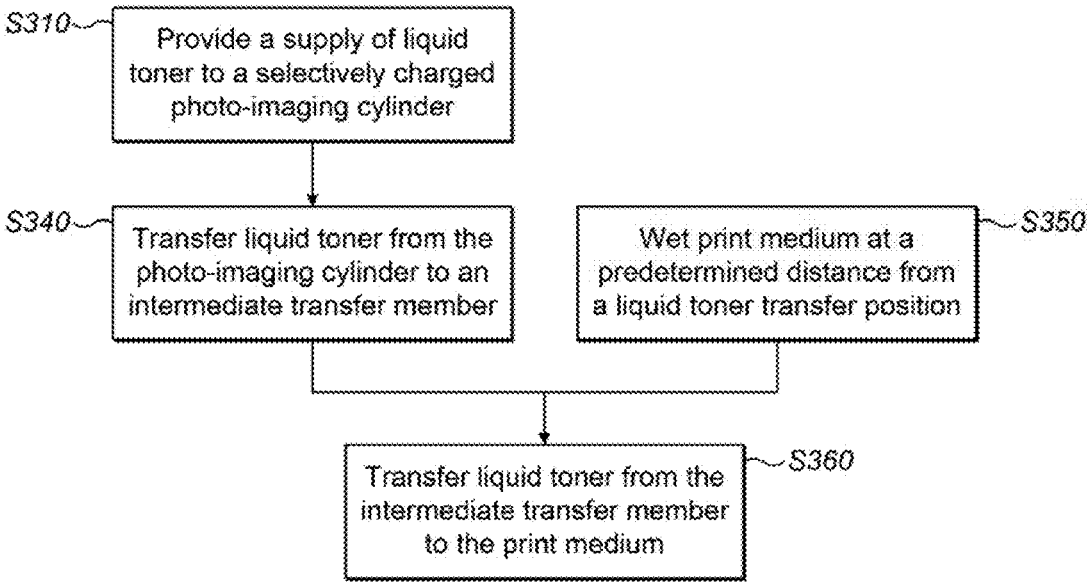
FIG. 3*b* is a flow diagram representing a method of applying water to a print medium in accordance with an example.

FIG. 3*b* shows another method of applying ink to a print medium 108 according to an example. At block S310, a supply of ink or liquid toner is provided to a selectively charged photo-imaging cylinder 102 as described above in relation to FIG. 3*a*. At block S340 the ink is transferred from the photo-imaging cylinder 102 to an intermediate transfer member 106. At block S350, an aqueous solution such as water is applied to the print medium 108, for example by a water applicator 120, 220, 230, 250. The aqueous solution is applied by the water applicator 120 to the print medium 108 at a predetermined distance from an ink transfer region 116 and is applied at a predetermined time before ink transfer. In this case, the predetermined distance may vary corresponding with the feed speed of the print medium 108, to allow for an appropriate degree of absorption of the water into the print medium 108 without undue drying or spreading of the water to other regions of the print medium 140. For example, spreading of the water to other regions of the print medium may occur via surface flow or capillary action i.e. so that the print medium 108, or at least the surface of the print medium 108 on which ink is to be applied, is at an appropriate level of wetness. At block S360, the ink is transferred from the intermediate transfer member 106 to the print medium 108, i.e. following application of the aqueous solution to the print medium. The transfer of ink may be assisted by the application of a suitable pressure by an impression cylinder 114, as described above in relation to FIG. 1*a*.

In some examples, the water may be applied to the print medium 108 at a predetermined time prior to ink transfer. This may be between approximately one second and several minutes prior to ink transfer in the cases wherein the wetting step is performed "inline" by the printing system 100. In other examples, the water may be applied to the print medium 108 several minutes or hours prior to ink transfer; for example, if the wetting is performed "offline" either manually or by a separate device. Therefore, it will be understood that blocks S340 and S350 do not need to be performed in any particular order provided that the print medium 108 is wetted prior to transfer of ink to the print medium 108, as shown in FIG. 3*b*.

The effect of applying a film of water to the print medium 108 prior to applying ink to the print medium 108 has been tested using a number of different types of print medium 108 by subjecting the print media 108 to a 'peeling test' after printing.

The peeling test involves applying an adhesive tape (3M#230) to the printed area ten minutes after printing and applying direct pressure with a roller passed over the print medium 108 ten times. The tape is then removed (over a 1.5 second interval) in a 180° loop, i.e. the tape was pulled back sharply onto itself. In the present case, the test was repeated on a previously untested portion of print medium 108 at various times after printing.

Figure 4:
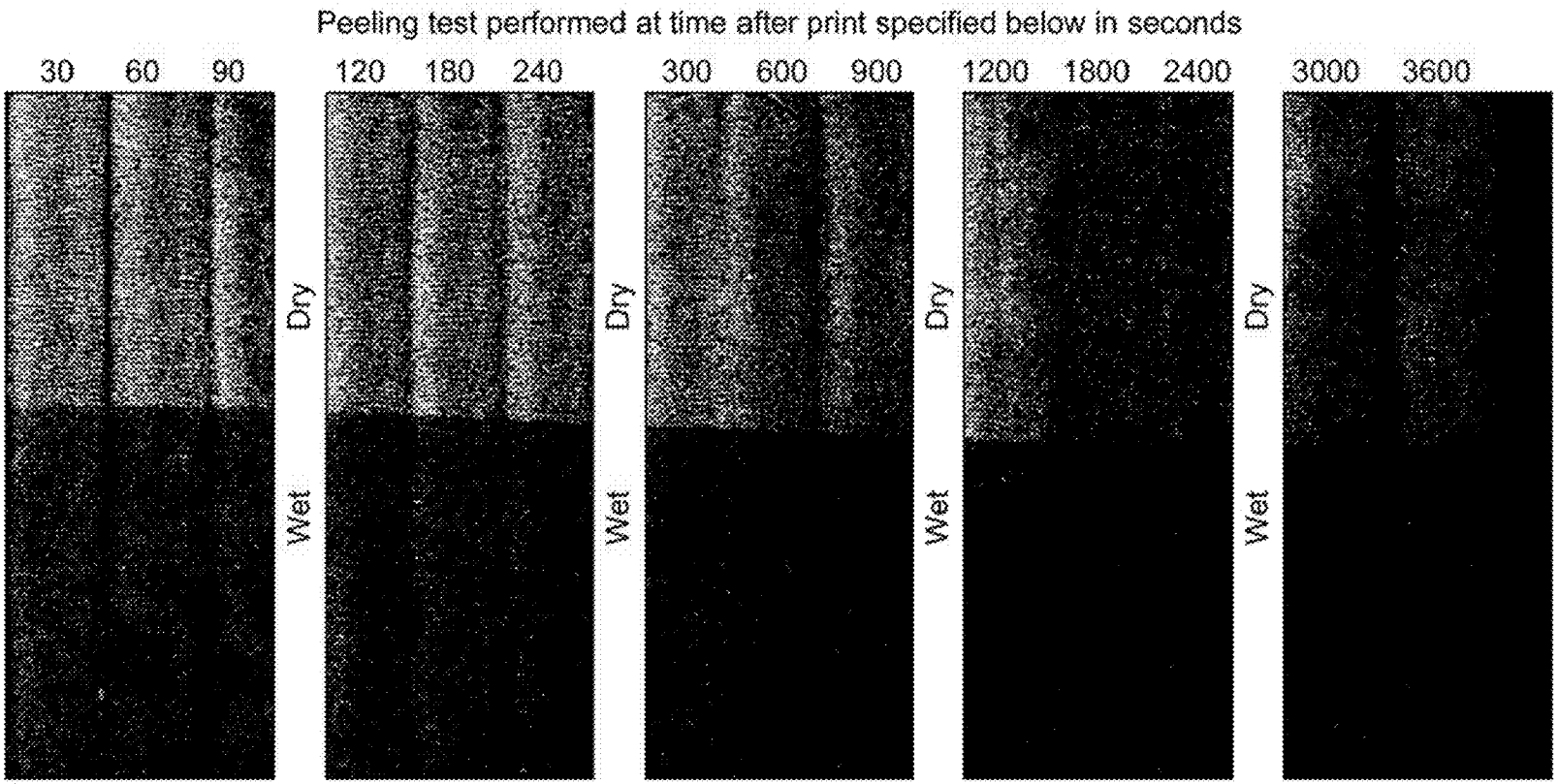
FIG. 4 is an image showing the results of peeling test demonstrating the effect of applying water to a print medium prior to transferring ink to the print medium in accordance with an example.

FIG. 4 is an image of a series of five print medium samples ("Condat Gloss") onto which test print samples were printed; the printed test samples were then subjected to the peeling test. As described above, the ink was 'peeled' at several times after the print. In the image, areas of the print medium 108 in which ink remains appear black and areas of the print medium 108 in which the ink has peeled appear white. Therefore, the less white that appears after the peel test, the better the adhesion of the ink to the print medium 108.

Each of the test samples shown in FIG. 4 contains multiple test areas, arranged in columns. Each column represents a time after printing when a test was performed. Each column contains a "dry" area, which is untreated, and a "wet" area, which has had water applied to it prior to printing. The columns are arranged such that the left-most column represents a test performed at a first time after printing. Columns to the right of the leftmost column represent tests performed at increasing times, i.e. at second to fifth times after printing.

As can be seen in FIG. 4, columns that represent "dry" test results performed sooner after printing appear lighter than those representing tests performed after a longer period has elapsed after printing. This shows that there is an improvement in ink adhesion, or "fixing" as the ink is left on the sample for longer. As can also be seen in FIG. 4, for tested times, the "wet" portion of the test sample appears darker than the "dry portion of the test sample. This shows that the ink adheres, or 'fixes' much more securely to portions of print medium 108 that have been 'wetted' prior to the application of ink than to portions of the print medium 108 that are not wetted prior to applying ink.

Figure 5:
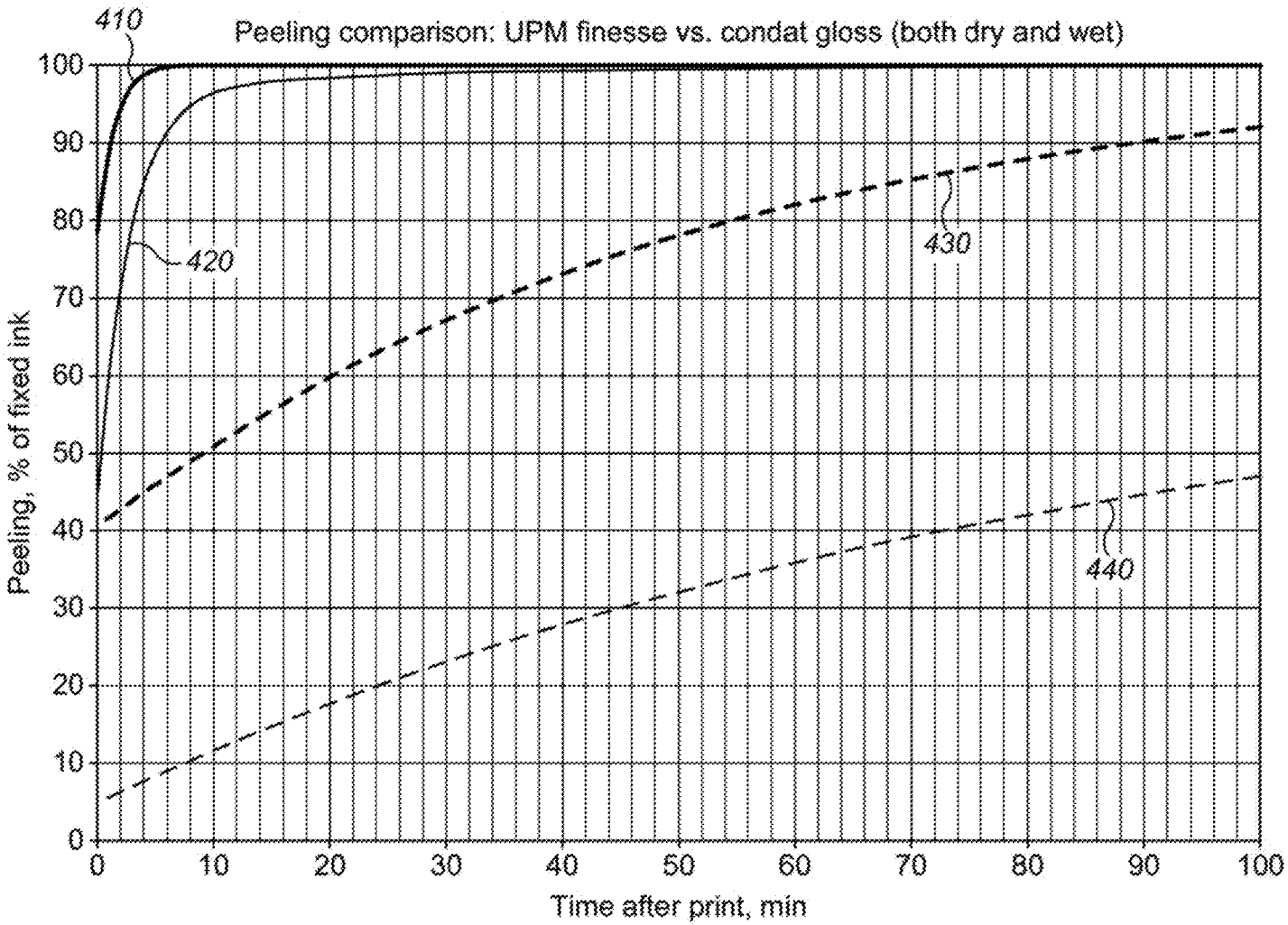
FIG. 5 is a graph showing the degree of peeling of ink applied to a print medium where the ink is applied with and without applying water to the print medium prior to ink transfer for two different print media.

FIG. 5 shows a graph of the degree of peeling, plotted against the time after printing, for two kinds of substrates: "Condat Gloss" and "UPM Finesse". The solid lines represent Condat Gloss "wet" 410 and Condat Gloss "dry" 420, and the dashed lines represent UPM Finesse "wet" 430 and UPM Finesse "dry" 440. The degree of peeling is expressed as a percentage of 'fixed' ink (i.e. the percentage of the print medium where ink was applied that has ink remaining after the peeling test). "Condat Gloss" is a substrate with good ink fixing Properties, while "UPM Finesse" has less good fixing properties. Plots showing the behavior of the ink when applied to wetted and non-wetted print media are shown.

As can be seen in FIG. 5, both types of print medium show improved ink fixing when the print medium is wetted (with water) prior to ink being applied. In both cases, the degree of peeling is reduced by the application of a film of water (at all times after printing), and the time taken to achieve a given degree of fixing is reduced for both types of substrate. Ink applied after application of a film of water also demonstrates improved scratch resistance, which helps the print medium withstand further finishing processes.

Furthermore, the improvements described above can be achieved without changing the ink transfer parameters, and so the method can be applied to existing LEP systems, or existing systems can be retrofitted to include applicators for performing the wetting method described herein.

Water is a relatively low cost material (compared to solvents and/or specialized print media) and in many LEP systems is already readily available in the press as a byproduct of the operation of the Capture and Control unit. Water is also safe, environmentally friendly (unlike primers and adhesion promoters, which often contain solvents), and is relatively stable. It is thus unlikely to contaminate components of the printing device.

The proposed method improves ink adhesion conditions without significantly modifying printing process parameters. A demonstrable improvement, at full printing speed in LEP printing systems, is achieved by treating the print media by applying a thin layer of water on substrate prior to the ink transfer point.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A method comprising:

providing a supply of liquid toner to a selectively-charged photo-imaging cylinder;

wetting a print medium by applying a wetting agent to a location on the print medium using an applicator, the applicator movable to set a distance between the location where the wetting agent is applied to the print medium by the applicator and a position where the liquid toner is transferred to the print medium; and subsequent to wetting the print medium, transferring the liquid toner from the photo-imaging cylinder to the print medium.

2. The method according to claim 1, wherein wetting the print medium comprises wetting the print medium with an aqueous wetting agent.

3. The method according to claim 2, wherein the aqueous wetting agent comprises water.

4. The method according to claim 2, comprising applying the aqueous wetting agent to the print medium by one or more of: spraying; atomizing; vaporizing; and capillary action.

5. The method according to claim 2, comprising applying the aqueous wetting agent to the print medium using one or more of a wetting roller, a wiper, a rod, and a doctor blade.

6. The method according to claim 2, comprising:

applying the aqueous wetting agent to the print medium at a predetermined temperature.

7. The method according to claim 1, wherein transferring the liquid toner from the photo-imaging cylinder to the print medium comprises transferring the liquid toner from the photo-imaging cylinder to the print medium via an intermediate transfer member; and wherein the print medium is wetted prior to the transfer of the liquid toner to the print medium.

8. The method according to claim 1, wherein the print medium comprises a paper-base substrate.

9. The method of claim 1, wherein the applicator unit comprises an atomizer nozzle to inject a gas and to carry the wetting agent in a flow of the gas to the print medium.

10. The method of claim 1, further comprising moving the applicator from a first position to a second position based on a type of the print medium to adjust the distance between the location where the wetting agent is applied to the print medium and the position where the liquid toner is transferred to the print medium.

11. The method of claim 1, further comprising moving the applicator from a first position to a second position to adjust print quality of an image printed on the print medium.

12. An apparatus for use with a printing device comprising:

an applicator arranged to apply a wetting agent to a print medium prior to transfer of a liquid toner from a photo-imaging cylinder to the print medium, wherein the applicator is movable to set a distance between a location where the wetting agent is applied to the print medium and a transfer region where the liquid toner is transferred to the print medium.

13. The apparatus according to claim 12, wherein the applicator comprises a nozzle arranged to direct a flow of the wetting agent toward the print medium.

14. The apparatus according to claim 13, wherein the nozzle is arranged to direct a spray of the wetting agent toward the print medium.

15. The apparatus according to claim 12, wherein the applicator comprises a wetting agent transfer portion, the wetting agent transfer portion being arranged to make contact with the print medium and in making contact with the print medium transfer the wetting agent to the print medium.

16. The apparatus according to claim 15, wherein the wetting agent transfer portion comprises a material arranged to transfer the aqueous wetting agent by capillary action.

17. The apparatus according to claim 15, wherein the wetting agent transfer portion comprises a roller having a cylindrical surface to hold the wetting agent, the roller being arranged to roll across a surface of the print medium.

18. An apparatus according to claim 12, comprising:

a photo charging unit arranged to form an electrostatic charge pattern on the photo-imaging cylinder;

a supply of liquid toner;

an intermediate transfer member arranged to transfer liquid toner the photo-imaging cylinder to the print medium; and a supply of water.

19. The apparatus of claim 12, wherein the applicator unit comprises an atomizer nozzle to inject a gas and to carry the wetting agent in a flow of the gas to the print medium.

20. The apparatus of claim 12, wherein the applicator is movable from a first position to a second position to adjust, based on a type of the print medium, the distance between the location where the wetting agent is applied to the print medium and the transfer region.

* * * * *